US006988849B1

(12) United States Patent
Zimmerman

(10) Patent No.: US 6,988,849 B1
(45) Date of Patent: Jan. 24, 2006

(54) POTHOLE REPAIR MACHINE

(76) Inventor: Harold M. Zimmerman, 187 Wabash Rd., Ephrata, PA (US) 17522

( * ) Notice: Subject to any disclaimer, the term of this patent is extended or adjusted under 35 U.S.C. 154(b) by 0 days.

(21) Appl. No.: 10/944,219

(22) Filed: Sep. 17, 2004

(51) Int. Cl.
*E01C 23/14* (2006.01)

(52) U.S. Cl. ..... 404/95; 404/75; 404/79

(58) Field of Classification Search ..... 404/72, 404/75, 77, 79–82, 83, 84.05, 90–92, 101, 404/118, 95
See application file for complete search history.

(56) References Cited

U.S. PATENT DOCUMENTS

| | | | | |
|---|---|---|---|---|
| 4,215,949 A | | 8/1980 | Gabriel, Jr. | 404/110 |
| 4,557,626 A | | 12/1985 | McKay et al. | 404/90 |
| 5,131,788 A | | 7/1992 | Hulicsko | 404/108 |
| 5,294,210 A | | 3/1994 | Lemelson | 404/84.1 |
| 5,333,969 A | | 8/1994 | Blaha | 404/91 |
| 5,439,313 A | * | 8/1995 | Blaha et al. | 404/75 |
| 5,752,782 A | | 5/1998 | Hulicsko | 404/103 |
| 5,967,695 A | | 10/1999 | Vural | 404/77 |
| 6,056,474 A | | 5/2000 | Nolan | 404/118 |
| 6,439,806 B1 | | 8/2002 | Dillingham | 404/95 |
| 6,821,052 B2 | * | 11/2004 | Zurn | 404/84.5 |

* cited by examiner

*Primary Examiner*—Thomas B. Will
*Assistant Examiner*—Alexandra Pechhold
(74) *Attorney, Agent, or Firm*—Miller Law Group, PLLC

(57) ABSTRACT

A pothole repair machine utilizes hot mix asphalt material to fill the pothole being repaired. The machine includes a heating apparatus for raising the temperature of the surface of the road surrounding the pothole to soften the material for bonding with the material to be inserted into the pothole. A hot tack spray is then placed onto the surface of the pothole before hot mix material is deposited into the pothole cavity. Before depositing the hot mix material, a sensing mechanism determines the depth of the pothole and causes an adjustment of the height of screening doors to effect the uncompressed height of the filling material at a predetermined percentage of overfill before a vibrating roller compresses the filling material to the level of the surrounding roadway. A plurality of screening doors extends along the transverse width of the machine, each door being adjustably controlled by a depth sensor member.

20 Claims, 4 Drawing Sheets

POTHOLE REPAIR MACHINE

BACKGROUND OF THE INVENTION

The present invention is directed to machines for laying asphalt paving material and, more particularly, to a machine for repairing potholes in paved road surfaces.

Machines for repairing potholes are known in the art; however, most known pothole repair machines, such as is shown in U.S. Pat. No. 5,131,788, issued to Leslie Huliesko on Jul. 21, 1992; in U.S. Pat. No. 5,294,210, issued to Jerome Lemelson on Mar. 15, 1994; and in U.S. Pat. No. 5,752,782, issued to Leslie Huliesko on May 19, 1998, are designed to dispense a cold patch material in which the asphalt paving material is combined with an emulsion to provide a plastic paving material that will harden when placed into the environment. Such cold patch asphalt paving material is typically utilized in cold weather installations and suffers from the limitation of not being able to bond with the existing adjacent, contiguous paving material to enable the patch material to remain in place. Thus, pothole repairs accomplished in this manner are often temporary.

One approach often taken to attempt to prolong the life of a cold patch pothole repair is to spray a coating of tack material into the open pothole before dispensing the cold patch asphalt material into the pothole. The tack coat is conventional in the art of repairing potholes, as is disclosed in U.S. Pat. No. 4,557,626, issued to Jack McKay on Dec. 10, 1985, and in U.S. Pat. No. 4,215,949, issued to Gifford Gabriel on Aug. 5, 1980, in which the tack coat (or bonding agent) is sprayed into the pothole before the introduction of the cold patch material in an effort to make the cold patch material adhere to the bottom and sides of the pothole.

In U.S. Pat. No. 5,967,695, issued to Gulertan Vural on Oct. 19, 1999, and in U.S. Pat. No. 4,557,626, (McKay), the pothole repair machine is provided with a heating apparatus to heat the pothole and surrounding asphalt material primarily to remove excess material from the hole and from the surface of the roadway surrounding the pothole. Furthermore, in U.S. Pat. No. 5,967,695 (Vural) the process undertaken in the machine is to overfill the pothole and compact the filling material to a level higher than the surrounding roadway, whereupon the machine utilizes a vertically adjustable doctor blade to remove the excess filling material following which the filling material is again compacted.

U.S. Pat. No. 5,333,969, issued to James Blaha, et al on Aug. 2, 1994, discloses a self-propelled pothole repair machine in which the potholes can be repaired with hot mix asphalt filling material. The Blaha machine includes an insulated hood formed by an assembly of retractable doors to control the ambient temperature around the pothole during the repair process. The Blaha machine further includes a device for enlarging and making the shape and size of the pothole uniform before the filing material is added to the pothole for repair thereof. A portable cart for repairing potholes is disclosed in U.S. Pat. No. 6,439,806, issued to Harold Dillingham on Aug. 27, 2002, in which the process utilizes hot mix filling material to repair potholes. In U.S. Pat. No. 6,056,474, issued to David Nolan on May 2, 2000, a mechanism for controlling the height of a strike-off plate on an asphalt paver in response to the pitch angle of the screed is disclosed.

Such prior art pothole repair machines have not been configured to provide an efficiently operable and economically affordable system for the consistent repair of potholes. The Blaha machine, for example, is a large cumbersome apparatus in which the process is attempted to be automated.

The Dillingham cart, on the other hand, is too small to be efficient in the repair of a large quantity of potholes. Cold patch pothole repair machines cannot provide a lasting repair, even with the utilization of a tack coat before the filling material is added to the pothole. Potholes are not formed in a regular uniform manner and uniformity cannot be relied upon in formulating a process to effect their repair. Accordingly, it would be desirable to provide a pothole repair machine that would be consistently and effectively operable to repair potholes, resulting in a repair that becomes consistent with the surrounding surface of the roadway.

SUMMARY OF THE INVENTION

It is an object of this invention to overcome the aforementioned disadvantages of the prior art by providing a pothole repair machine that will utilize a hot mix asphalt material to fill pothole for repair thereof.

It is another object of this invention to provide a pothole repair machine that provides a cost effective process for the repair of potholes in roadway surfaces.

It is a feature of this invention that the pothole repair machine incorporates a series of vertically adjustable doors to screen the filling material being deposited into a pothole for repair thereof.

It is an advantage of this invention that filling material is consistently overfilled by a predetermined percentage in order to compress to the level of the surrounding surface of the roadway.

It is another feature of this invention that the vertically adjustable doors are connected to a linkage mechanism that senses the depth of the pothole to be repaired so that the depth of filling material is overfilled by the predetermined percentage.

It is another advantage of this invention that the filling material can be compressed uniformly to the level of the surrounding surface of the adjacent roadway.

It is still another feature of this invention that the height of the vertically adjustable doors can be individually varied across the transverse width of the pothole repair machine.

It is still another advantage of this invention that the height of the entire machine above the surface of the roadway can be adjusted.

It is yet another feature of this invention that the pothole repair apparatus is enclosed within an insulated hood that controls the ambient temperature of the area around the pothole being repaired so that the temperature of the hot mix filling material will not cool until the pothole is repaired.

It is yet another advantage of this invention that the roadway surface around the pothole to be repaired is heated to facilitate the bonding of the filling material into the surface of the surrounding roadway.

It is a further feature of this invention that the machine can be trailed behind a conventional highway truck for transport over the surface of the highway for access to potholes to be repaired.

It is a further advantage of this invention that the vertically adjustable doors are automatically positioned in response to the sensed depth of the pothole being repaired.

It is yet another object of this invention to provide a pothole repair machine that is durable in construction, inexpensive of manufacture, carefree of maintenance, facile in assemblage, and simple and effective in use.

These and other objects, features and advantages are accomplished according to the instant invention by providing a pothole repair machine utilizing hot mix asphalt material to fill the pothole being repaired. The machine includes a heating apparatus for raising the temperature of the surface of the road surrounding the pothole to soften the material for bonding with the material to be inserted into the pothole. A hot tack spray is then placed onto the surface of the pothole before hot mix material is deposited into the pothole cavity. Before depositing the hot mix material, a sensing mechanism determines the depth of the pothole and causes an adjustment of the height of screening doors to effect the uncompressed height of the filling material at a predetermined percentage of overfill before a vibrating roller compresses the filling material to the level of the surrounding roadway. A plurality of screening doors extends along the transverse width of the machine, each door being adjustably controlled by a depth sensor member.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
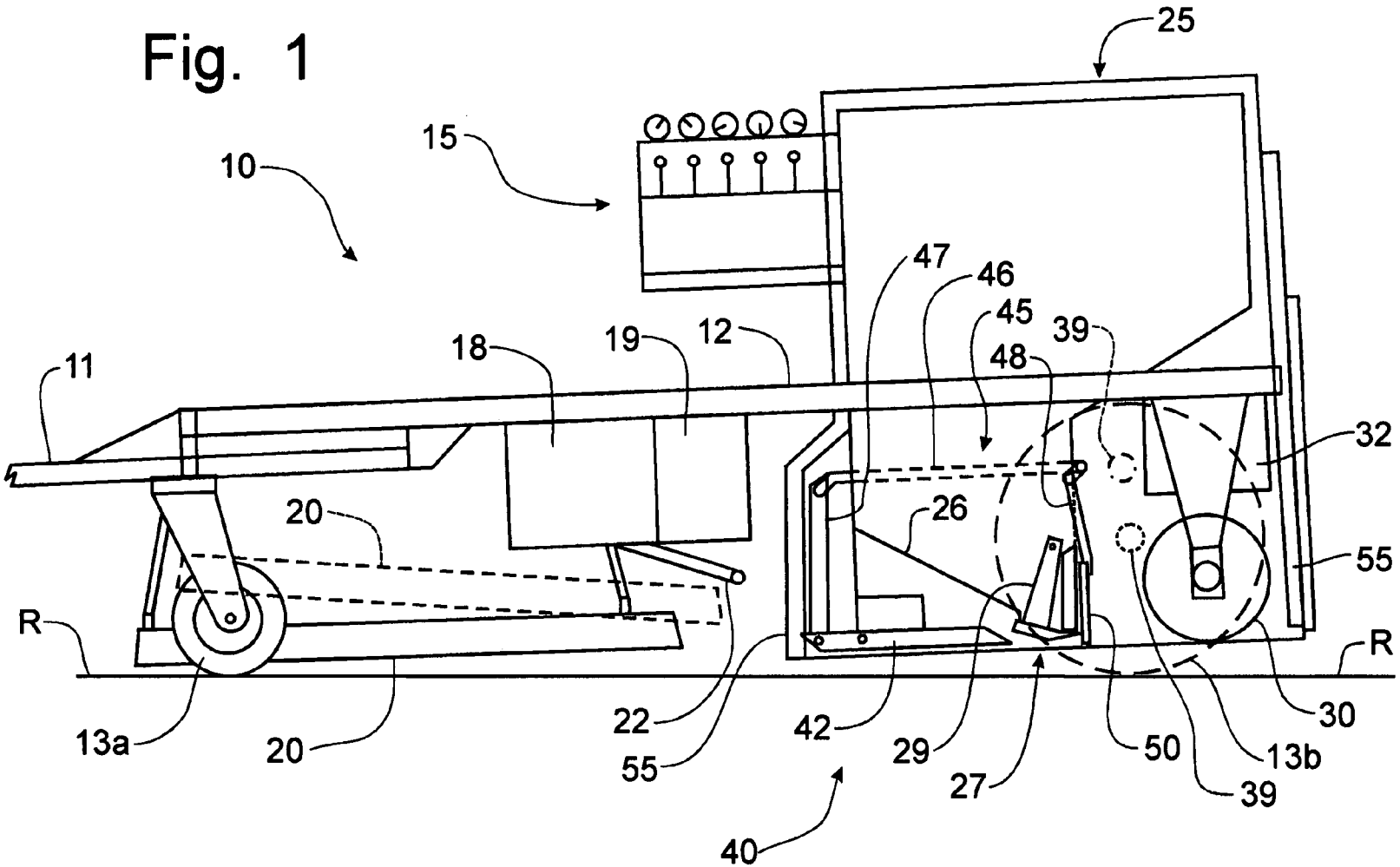
FIG. 1 is a schematic side elevational view of a pothole repair machine incorporating the principles of the instant invention, the pothole repair machine being depicted in a transport configuration with the frame raised relative to the rear axle, the forward road heater being depicted in alternate transport positions with a raised transport position being shown in phantom, the maximum movement of the frame relative to the rear axle being depicted by the position of the rear axle in phantom.

Referring to the drawings, a pothole repair machine incorporating the principles of the instant invention can best be seen. The machine 10 is preferably a towed implement that can be attached to a pick-up truck (not shown) or a highway truck (not shown) by a trailer hitch 11 to be moved from one location to another. In the alternative, the machine 10 could be a self-propelled apparatus in which an engine is operatively mounted on the machine 10 to provide operative and motive power. The machine 10 includes a frame 12 supported above the ground by a pair of front wheels 13*a* and a pair of rear wheels 13*b*. The frame 12 also supports a heated material hopper 25 for holding a supply of hot mix asphalt material. Manually operable controls 15 are associated with a hydraulic system (not shown) to control the operation of the various functions to be described and defined in greater detail below. The frame 12 also supports additional reservoirs 18, 19 for heated asphalt tack coat spray material and heated oil for a self-contained heating system described in greater detail below.

At the forward end of the machine 10, a gas-fired road heater 20 is positioned adjacent the surface of the road R to heat the roadway surface sufficiently to soften the surface for bonding purposes, as will be described in greater detail below. Immediately rearwardly of the road heater 20, a spray device 22 is positioned to spray a hot tack coat of asphalt coating material from the reservoir 18 onto the bottom surface of the pothole H. The heated material hopper 25 terminates in a sloped delivery chute 26 that directs the heated asphalt patch material toward a discharge opening 27. A pivoted gate 29 covers the discharge opening 27 and is controlled through the manual controls 15 to expose the discharge opening 27 for the delivery of heated asphalt fill material into the pothole H. Preferably, the pivoted movement of the gate 29 is hydraulically controlled, but electric or mechanical controls would also be operable to control the discharge of asphalt fill material from the hopper 25.

Once the asphalt fill material has been placed into the pothole H, a compacting roller 30, preferably with an associated vibrating mechanism (not shown) to better compact the fill material, is supported at the rear of the frame 12 to compact the fill material to the level of the surrounding road surface R. As is conventional with compacting rollers, water can be added to the interior of the roller assembly to increase the weight of the roller 30. Furthermore, water can be added to a reservoir 32 supported at the rear of the frame 12 in conjunction with the roller 30 to further increase the weight asserted against the fill material for compaction thereof.

Hot mix asphalt fill material is known to compress by approximately 10%–25% when compacted. Accordingly, an overfilling of the pothole H by 10%–25%, measured as a function of the depth of the pothole H, will result in a compacting of the fill material to the level of the surrounding road surface R. To accomplish this overfilling of the pothole H by 10% to 25% of the depth of pothole, the pothole repair machine 10 is provided with an automatic depth adjustment mechanism 40.

Figure 2:
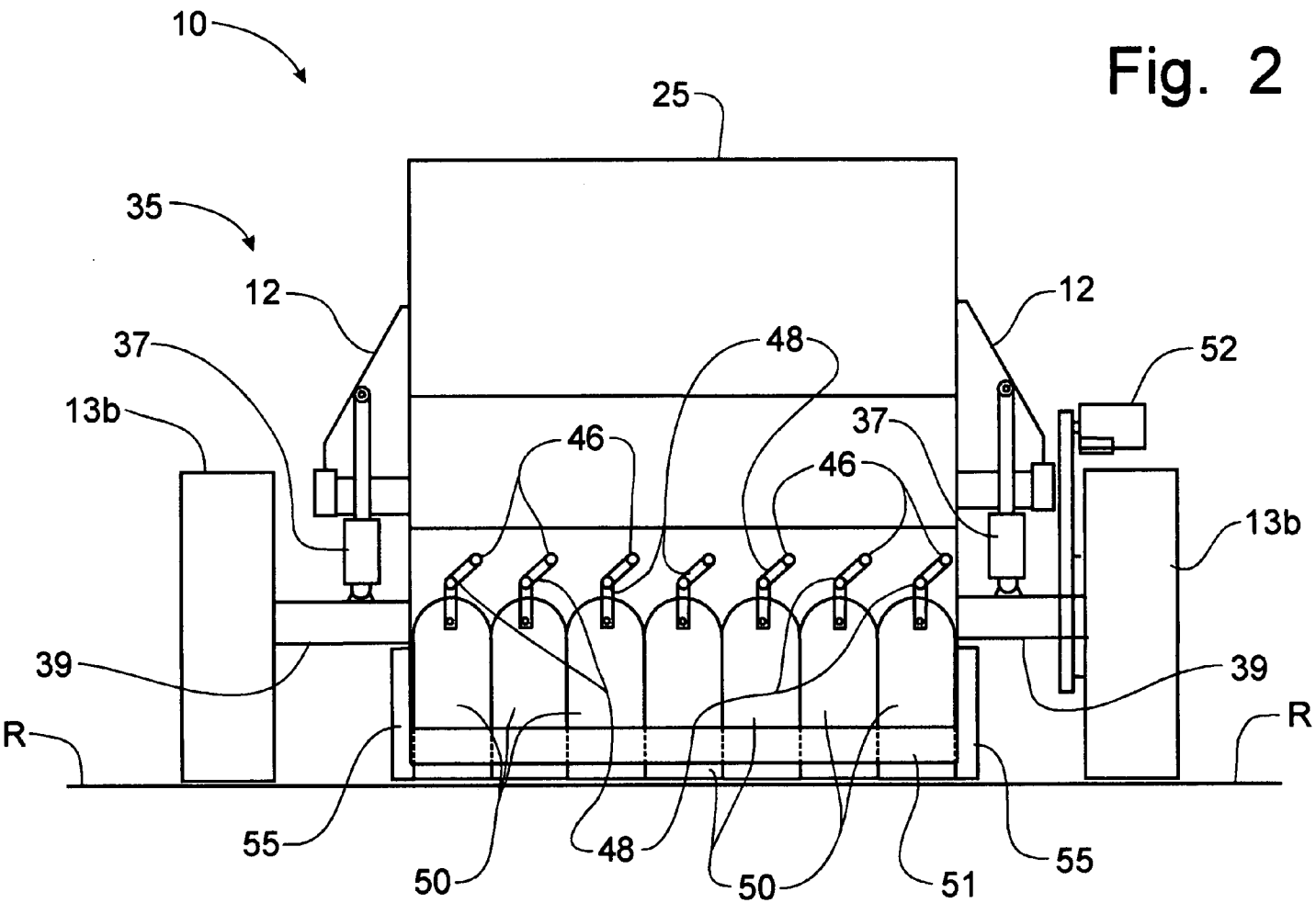
FIG. 2 is a schematic rear elevational view of the pothole repair machine shown in FIG. 1 with the rear compacting roller being removed to better depict the screening doors, but with the frame lowered to an operative position next to the surface of the road.
Figure 3:
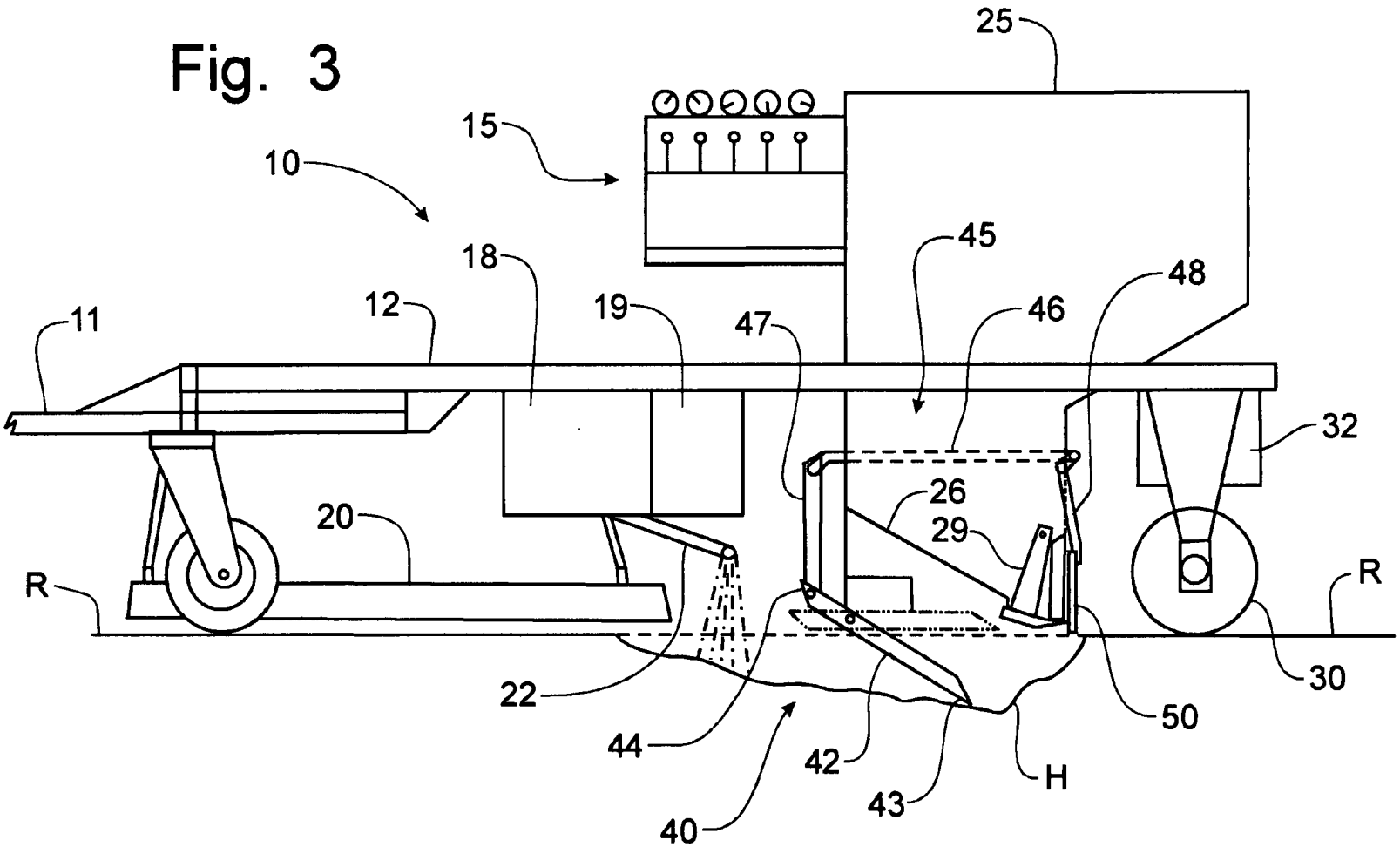
FIG. 3 is a schematic side elevational view of the pothole repair machine in an operative mode depicting the depth sensor members in operation, the transport position of the sensor members being shown in phantom and the spray of the hot tack coating also being depicted.
Figure 4:
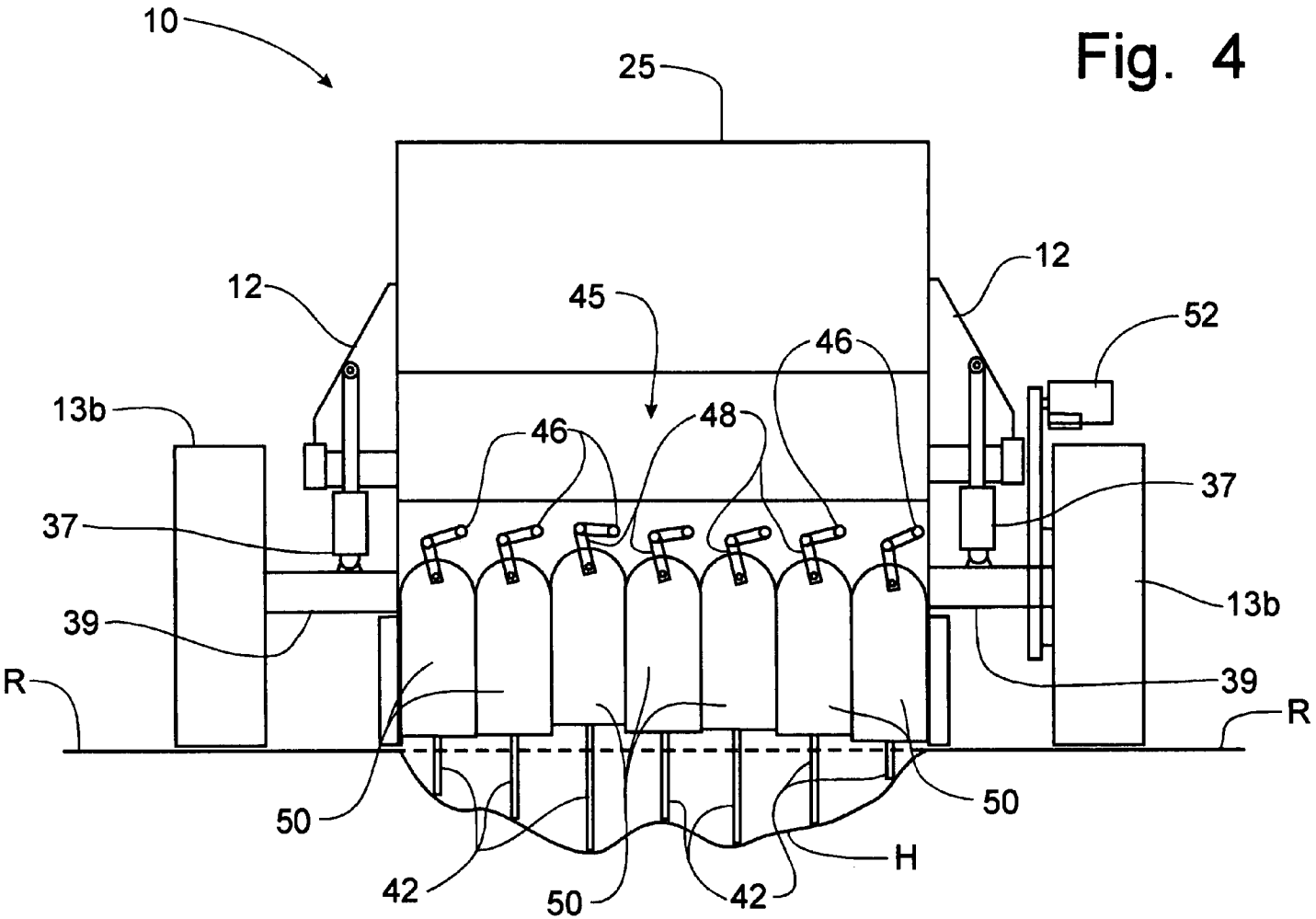
FIG. 4 is a schematic rear elevational view of the pothole machine similar to that of FIG. 2, but showing the movement of the screening doors as actuated by the pivoted sensor members engaged with the bottom surface of a pothole, the brace for the doors being removed for purposes of clarity.

The automatic depth adjustment mechanism 40 includes pivoted sensor members 42 that are pivotally supported on the frame 12 so that the distal end 43 of each respective sensor member 42 will drop into the pothole H and float against the bottom of the pothole H. A linkage 45 interconnects the forward end 44 of the sensor member 42 with a vertically movable door 50, as is best seen in FIG. 2, that serves to screen the fill material placed into the pothole H. The linkage 45 is connected in a manner that raises the door 50 in response to dropping into the pothole H a greater distance. Accordingly, the deeper the pothole H, the higher the door 50 would be positioned, leaving a greater height of the fill material in the pothole H above the surface of the road R. Thus, the depth of the non-compacted fill material is in direct proportion to the depth of the pothole H. The function of the doors 50 is to screen off the fill material placed into the pothole H from the hopper 25, and to shape the overfill of the fill material into a configuration that correlates to the corresponding depth of the pothole H.

The linkage 45 can include a rotatable mounted shaft 46, corresponding to each respective set of pivoted sensor member 42 and corresponding screening door 50, passing through the fill hopper 25 to exit rearwardly thereof to connect with the screening doors 50. In such a mechanical arrangement, the pivotal movement of the sensor member 42 will cause a corresponding rotation of the shaft 46 through a connecting link 47, which in turn effects an appropriate raising of the screening door 50 through a rearward connecting link 48. A lost motion slot (not shown) in the rearward conning link 48 can be utilized to position the screening door 50 at the maximum height corresponding to the maximum depth identified by the corresponding sensor member 42 for each respective pothole H being repaired. A resetting of the doors 50 to the lowered position would reset the machine for the next pothole repair. Alternatively, a more accurate screening of the fill material can be accomplished through an electronic control system in which the sensed depth of the pothole H would be reflected in the varying height of the screening door 50 as the screening door 50 actually passes over the pothole being repaired.

As is best seen in FIG. 2, multiple doors 50 span the transverse width of the machine 10. Each vertically adjustable door 50 is connected to a separate sensor member 42 so that each door 50 is positioned in direct correlation with the depth of the pothole H corresponding to the area covered by the door 50. Accordingly, the amount of fill material overfilling the pothole H above the surface of the road R will vary from one door 50 to the other in response to the sensed depth of the pothole H. One skilled in the art will recognize that the greater the number of doors are provided, the finer the calibration of the height of the fill material will be; however, from a practical consideration, the number of doors 50 should be in the range of 6 to 10. A brace 51 is connected to the frame 12 and positioned immediately behind the screening doors 50 so that the engagement with the fill material will not deflect the doors 50 rearwardly.

Referring now to FIGS. 1 and 2, the machine 10 is provided with a depth adjuster 35, preferably in the form of a pair of hydraulic cylinders 37 interconnecting the frame 12 and the rear axle 39 so that the frame 12 can be raised and/or lowered relative to the surface of the road R, thus providing a height adjustment for the entire machine 10. Furthermore, by independently controlling the two hydraulic cylinders 37, the machine 10 can be oriented angularly with respect to the level of the road surface R. As seen best in FIG. 2, a hydraulic motor 52 is operatively connected with the rear axle 39 to effect a driving of the machine 10 over the surface of the road R. Accordingly, once the pothole repair machine 10 is driven to a location at which potholes H are desired to be repaired, the machine 10 can be disconnected from the towing vehicle (not shown) and mobilely moved over the surface of the road R in either a forward or rearward direction by operating the hydraulic motor 52.

To maintain an elevated temperature within the operative area for repairing the pothole, the operative area being defined at a minimum as the area in which the delivery chute drops the hot mix asphalt material into the pothole H, the area in which the screening doors 50 define the height of the overfill of material within the pothole H, and the area over which the fill material is being compacted, an insulated hood 55 is supported from the frame 12 around the operative area. Furthermore, a closed circuit, self-contained circulation system circulates heated oil from the reservoir 19 through the delivery chute 26 and through the compacting roller 30 to assist in maintaining the elevated temperatures within the operative area. To also assist in maintaining the elevated temperatures of the hot mix asphalt fill material, the circulation system can also circulate the heated oil around the insulated fill material hopper 25.

Operating the road heater 20, as well as heating the oil for circulation within the circulation system, requires a heating system (not shown) which will be understood by one of ordinary skill in the art as being supported on the frame 12 and will preferably utilized propane gas or the equivalent to provide the necessary energy for raising and maintaining the temperatures as described above. Furthermore, the various hydraulically controlled functions, such as the hydraulic cylinders 37, the movable gate 29 on the delivery chute 26, the operation of the hydraulic motor 52, optional raising and lowering of the road heater 20, direction the spraying of the tack coat, etc., requires a hydraulic system (not shown) on the machine 10. Such a hydraulic system, as will be readily understood by one of ordinary skill in the art, can be self-contained on the machine 10 or be powered by a remote source, such as the hydraulic system on the prime move (not shown) moving the machine while in the transport mode.

In operation, the surface of the road R is heated by the road heater 20 until the road surface R is softened. An optional blower (not shown) can be utilized to clear debris or other loose material out of the pothole H, preferably before the road heater 20 is utilized. After the surrounding asphalt has been softened, a tack coat is sprayed into pothole H to cover the bottom surface of the pothole H to help the fill material to bond to the surfaces of the pothole. The sensor members 42 are released from a transport position described in greater detail below to pivot relative to the frame 12 to float against the bottom surface of the pothole H. Each sensor member 42 is connected to a corresponding door 50 through a linkage 45 that passes through the fill material hopper 25 to effect movement of the screening door 50 in response to the pivoted position of the sensor member 42 against the bottom of the pothole H.

After spraying the tack coat into the pothole H, the asphalt fill material is dropped from the hopper 25 through the delivery chute 26, controlled through operation of the gate 29, into the pothole H overfilling the pothole H. The rearwardly disposed screening doors 50 are positioned at a height to screen off the excess fill material so that the overfill of fill material is set at about 110% to 125% of the depth of the pothole H. The vibrating roller 30 compacts the fill material to the level of the surrounding road surface R. Since the surrounding road surface R has been softened through the operation of the road heater 20, the compacting roller 30 bonds the fill material into the surrounding road surface R to provide an improved durability for the pothole repair.

The insulated hood 55 surrounds the machine 10 to maintain the heat generated by the road heater 20 and other components of the pothole repair machine 10 within the operative area of the machine 10. Once the surrounding road surface R has been softened by the road heater 20, the ambient temperature needs to be maintained to keep the surface in a softened state and to keep the fill material from cooling as it is being deposited into the pothole H and compacted by the roller 30. Once the fill material has been compacted and bonded into the surrounding road surface R, the fill material is permitted to cool and harden into a permanent patch for the road surface.

After the potholes have been repaired and it is desired to move the pothole repair machine 10 to a new location, the hydraulic cylinders 52 are activated to raise the frame 12 relative to the road R and place the frame 12 into a transport configuration. The sensor members 42 are raised into a transport position, as best seen in FIG. 1, and locked by a lock pin (not shown) to fix the linkage 45 and the sensor members 42 in a raised, transport position. The screening doors 50 are then also fixed into a lowered transport position corresponding to the raised position of the sensor members 42. Once transported to a new job site, the pothole repair machine 10 can be returned to an operative configuration simply by lowering the frame to the surface of the road R, the transport and operative positions of the frame 12 relative to the rear axle 39 being depicted in FIG. 1 by the alternate locations of the rear axle 39, and releasing the locked sensor members 42 to ride against the adjacent surface of the road or bottom of the pothole H.

Because of the insulated hood 55 trapping the heat within the operative area of the machine 10, the pothole repair machine 10 can be utilized in the winter months as well as during the traditional warmer porthole repair months. The bonding of the fill material into the surrounding surface of the roadway, along with the utilization of a hot tack spray into the bottom of the pothole H, aids in the formation of a permanent pothole repair. The simplicity of the machine 10 permits the machine 10 to be cost effective in manufacture as well as in operation.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

The invention claimed is:

1. An apparatus for repairing potholes in a roadway surface, comprising:

a frame supported for movement over the roadway surface by ground-engaging wheels supported on at least one axle;

a fill material hopper supported on said frame to hold a supply of asphalt fill material, said hopper terminating in a delivery chute to direct the flow of fill material into a pothole;

a road heater forwardly mounted on said frame to be positionable adjacent to said roadway surface to heat and soften said roadway surface;

a tack coat spray apparatus for spraying a coating of a tack coat onto a bottom surface of said pothole;

a plurality of screening doors arranged transversely on said frame, each said screening door being vertically movable to vary the position of said screening door relative to said roadway surface, said screening doors being operable to screen off fill material in said pothole to an elevation above said roadway surface corresponding to the position of each respective said screening door;

a compacting roller supported from said frame rearwardly of said screening doors to compact said fill material to the level of said roadway surface; and a height adjustment mechanism mounted on said frame to sense a depth dimension of said pothole along a transverse width dimension of said pothole, said height adjustment mechanism being operatively coupled to said screening doors to affect a positioning of said screening doors to a position reflecting said depth dimension.

2. The apparatus of claim 1 wherein said height adjustment mechanism is operable to position each said screening door independently of all other said screening doors.

3. The apparatus of claim 2 wherein said height adjustment mechanism comprises:

a plurality of sensor members pivotally supported from said frame to permit engagement thereof with said bottom surface of said pothole, each said sensor member being positioned forwardly of a corresponding screening door; and linkage apparatus interconnecting each said sensor member with said corresponding screening door to effect said positioning of each said screening door in response to said depth dimension identified by said pivoted sensor member.

4. The apparatus of claim 3 wherein said linkage apparatus positions each respective said screening door at a position above said roadway surface corresponding to a predetermined ratio of said depth dimension of said pothole.

5. The apparatus of claim 4 wherein said predetermined percentage is approximately ten percent of said depth dimension.

6. The apparatus of claim 1 further comprising:

an insulated hood supported from said frame and defining an operative area encompassing said delivery chute, said screening doors, and said compacting roller.

7. The apparatus of claim 6 wherein said height adjustment mechanism is operable within said operative area.

8. The apparatus of claim 7 further comprising:

a heated circulation system operable to circulate heat to said delivery chute and to said compacting roller to maintain a temperature within said operative area.

9. The apparatus of claim 8 wherein said heated circulation system is operable to circulate heated oil from a reservoir supported on said frame through a closed circuit system.

10. The apparatus of claim 9 wherein said fill material hopper is also insulated and operatively connected to said heated circulation system to transfer heat to said fill material in said fill material hopper.

11. In a pothole repair machine having a frame, a fill material hopper for holding a supply of asphalt fill material, a delivery chute for directing said fill material into a pothole previously formed in a roadway surface, and a compacting roller for compacting said fill material after being placed into said pothole, the improvement comprising:

a plurality of screening doors arranged transversely on said frame, each said screening door being vertically movable to vary the position of each respective said screening door relative to said roadway surface; and a height adjustment mechanism mounted on said frame to sense a depth dimension of said pothole along a transverse width dimension of said pothole, said height adjustment mechanism being operable to affect a positioning of said screening doors to a position reflecting said depth dimension corresponding to each respective said screening door.

12. The pothole repair machine of claim 11 wherein said height adjustment mechanism comprises:

a plurality of transversely disposed sensor members pivotally supported from said frame to permit engagement thereof with said bottom surface of said pothole, each said sensor member being positioned forwardly of a corresponding screening door; and linkage apparatus interconnecting each said sensor member with said corresponding screening door to effect independent positioning of each said screening door in response to said depth dimension identified by the corresponding said pivoted sensor member.

13. The pothole repair machine of claim 12 wherein said linkage apparatus positions each respective said screening door at a position above said roadway surface corresponding to a predetermined ratio of said depth dimension of said pothole.

14. The pothole repair machine of claim 11 further comprising:

an insulated hood supported from said frame and defining an operative area encompassing said delivery chute, said screening doors, and said compacting roller.

15. The pothole repair machine of claim 14 further comprising:

a heated circulation system operable to circulate heated oil from a reservoir supported on said frame to said delivery chute and to said compacting roller to maintain an elevated temperature within said operative area.

16. A method of repairing potholes formed in a roadway surface, comprising the steps of:

heating said roadway surface surrounding said pothole to soften said roadway surface;

spraying a tack coating onto a bottom surface of said pothole;

sensing a depth dimension of said pothole by sensor members determining the position of said bottom surface of said pothole relative to said roadway surface along a plurality of transversely spaced locations within said pothole;

depositing an asphalt fill material into said pothole;

screening said fill material to a height above said roadway surface corresponding to a predetermined ratio of said depth dimension and incrementally adjusted with respect to said transversely spaced locations as determined by said sensor members; and compacting said fill material to the level of said roadway surface.

17. The method of claim 16 wherein said sensing step is accomplished by pivoting said sensor members into engagement with said bottom surface of said pothole.

18. The method of claim 17 wherein said screening step includes the step of positioning transversely arranged screening doors to a height above said roadway surface corresponding to said predetermined ratio of said depth dimension, said screening doors corresponding to said transversely spaced locations.

19. The method of claim 18 wherein said positioning step includes the step of interconnecting each said sensor member with corresponding said screening doors by a linkage to effect said positioning of said screening doors in response to the pivoted position of the corresponding said sensor members.

20. The method of claim 19 wherein compacting step includes the step of bonding said fill material into the softened surrounding roadway surface.

* * * * *